US011472057B2

(12) United States Patent
Roever et al.

(10) Patent No.: US 11,472,057 B2
(45) Date of Patent: Oct. 18, 2022

(54) MANUAL PRODUCE SLICER

(71) Applicant: The Vollrath Company, L.L.C., Sheboygan, WI (US)

(72) Inventors: Peter Roever, West Bend, WI (US); Jeff Fritz, Sheboygan, WI (US); Jill Hundley, Sheboygan, WI (US)

(73) Assignee: The Vollrath Company, L.L.C., Sheboygan, WI (US)

( * ) Notice: Subject to any disclaimer, the term of this patent is extended or adjusted under 35 U.S.C. 154(b) by 17 days.

(21) Appl. No.: 16/917,026

(22) Filed: Jun. 30, 2020

(65) Prior Publication Data

US 2021/0001505 A1 Jan. 7, 2021

Related U.S. Application Data

(60) Provisional application No. 62/869,336, filed on Jul. 1, 2019.

(51) Int. Cl.

| | |
|---|---|
| ***B26D 7/06*** | (2006.01) |
| ***B26D 1/03*** | (2006.01) |
| ***B26D 7/26*** | (2006.01) |
| ***B26D 7/08*** | (2006.01) |
| ***B26D 7/00*** | (2006.01) |

(52) U.S. Cl.

CPC ..... *B26D 7/0616* (2013.01); *B26D 1/03* (2013.01); *B26D 7/08* (2013.01); *B26D 7/2614* (2013.01); *B26D 2007/0018* (2013.01); *B26D 2210/02* (2013.01)

(58) Field of Classification Search

CPC ..... B26D 7/0616; B26D 1/03; B26D 7/2614; B26D 7/08; B26D 2007/0018; B26D 2210/02; B26D 7/0608; B26D 1/553; B26D 3/26; B26D 7/01; B26D 7/06; B26B 27/002; B26B 29/063; B26B 3/04; Y10S 83/932; A01F 29/005; A47J 43/25; A47J 47/00; Y10T 83/66; Y10T 83/6614; Y10T 83/222; Y10T 83/662; Y10T 83/6657; Y10T 83/8756; Y10T 83/6572; Y10T 83/9478; Y10T 83/0296; Y10T 83/7573

See application file for complete search history.

(56) References Cited

U.S. PATENT DOCUMENTS 269,835 A * 1/1883 De Puy ..... B26D 3/185 83/425.2
1,479,369 A * 1/1924 Chounis ..... B26D 3/185 83/425.3

(Continued)

FOREIGN PATENT DOCUMENTS

NL 9200375 A * 9/1993 ..... B26D 1/03

*Primary Examiner* — Jonathan G Riley
(74) *Attorney, Agent, or Firm* — Foley & Lardner LLP

(57) ABSTRACT

A manual food processor includes a base, a plurality of blades coupled to the base and extending from the base in a vertical direction, a rod coupled to the base and oriented at an acute angle relative to the vertical direction of the blade, and a carriage slidable along the rod from a top end of the rod to a bottom end of the rod. The carriage is configured to support a food item from below the food item and to push the food item from above the food item. The carriage is positioned entirely on a first side of the plurality of blades when at the top end of the rod and is intersected by the plurality of blades at the bottom end of the rod.

10 Claims, 10 Drawing Sheets

(56) References Cited

U.S. PATENT DOCUMENTS 1,748,997 A * 3/1930 Rentos ..... B26D 1/553 83/407
1,947,153 A * 2/1934 Dellinger ..... B26D 3/185 83/435.18
2,058,765 A * 10/1936 Blumenkranz ..... B26D 7/01 83/465
2,102,819 A 12/1937 Ronci
2,303,595 A * 12/1942 Young ..... B26D 3/185 83/404.2
2,437,123 A * 3/1948 Petskeyes ..... B26D 7/2614 83/751
2,522,143 A * 9/1950 Strassenburg ..... B26D 3/18 83/865
2,563,237 A * 8/1951 Grocoff ..... B26D 3/185 83/651.1
2,729,255 A * 1/1956 Small ..... A47J 43/25 241/101.01
3,369,582 A * 2/1968 Giangiulio ..... B26D 7/0608 83/425.3
3,605,839 A * 9/1971 Gerson ..... B26D 7/0608 83/425.3
3,605,840 A * 9/1971 Morrett ..... B26D 3/26 83/425.3
3,774,490 A * 11/1973 Gerson ..... B26D 7/0608 83/425.3
3,807,266 A * 4/1974 Camp ..... B26D 1/11 83/404.4
3,924,501 A * 12/1975 Cohen ..... B26D 5/10 83/404.3
3,948,132 A * 4/1976 Camp ..... B26D 1/03 83/425.3
4,095,339 A * 6/1978 Turner ..... B26B 27/002 30/114
4,144,784 A * 3/1979 Jones ..... B26D 7/22 83/425.3
4,184,397 A * 1/1980 Jones ..... B26D 1/03 83/425.3
4,254,678 A * 3/1981 Steiner ..... B26D 7/22 83/425.3
4,302,997 A * 12/1981 Jones ..... B26D 1/03 83/425.2
4,346,634 A * 8/1982 Jones ..... B26D 3/185 83/404.3
4,383,365 A * 5/1983 Metzigian ..... B26D 7/00 30/114
4,436,011 A * 3/1984 Jones ..... B26D 1/03 83/425.3
4,567,801 A * 2/1986 Jones ..... B26D 1/03 83/404.3
4,625,607 A * 12/1986 Maillez ..... B26D 1/30 30/114
4,646,602 A * 3/1987 Bleick ..... B26D 1/553 30/117
4,734,027 A 3/1988 Adams
5,035,056 A * 7/1991 Sheffield ..... B26D 1/553 30/305
5,373,781 A 12/1994 Knasel
6,143,391 A 11/2000 Barnes et al.
D520,817 S * 5/2006 Abrams ..... D7/673
D531,465 S * 11/2006 Tellier ..... D7/381
7,568,414 B2 * 8/2009 Farid ..... B26D 3/26 30/114
7,587,968 B1 * 9/2009 Roberts ..... B26D 3/185 83/404.3
8,495,941 B2 * 7/2013 Farid ..... B26D 3/24 83/620
9,226,608 B2 * 1/2016 Cotter ..... A47J 19/06
9,694,506 B2 7/2017 Whitney
9,908,252 B2 * 3/2018 Lopez ..... B26D 7/1818
9,914,229 B2 3/2018 Fastabend et al.
10,674,871 B2 * 6/2020 Wong ..... A47J 19/023
10,759,071 B2 * 9/2020 Chan ..... B26D 7/01
2004/0237741 A1 * 12/2004 Stinnett ..... B26D 1/553 83/425.3
2009/0007804 A1 * 1/2009 Heck ..... B26D 3/26 99/543
2010/0031830 A1 * 2/2010 Engdahl ..... B26D 3/26 99/538
2010/0175568 A1 * 7/2010 Fritz-Jung ..... B26D 1/553 99/537
2013/0081527 A1 * 4/2013 Zhu ..... B30B 1/04 83/632
2014/0208908 A1 7/2014 Whitney
2014/0208909 A1 7/2014 Whitney
2014/0208910 A1 7/2014 Whitney
2014/0208911 A1 7/2014 Whitney
2014/0208917 A1 * 7/2014 Whitney ..... B26D 5/10 83/858
2015/0224658 A1 8/2015 Whitney
2015/0224659 A1 8/2015 Whitney
2015/0224661 A1 8/2015 Whitney
2015/0224662 A1 8/2015 Whitney
2015/0224663 A1 * 8/2015 Whitney ..... B26D 3/20 83/164
2015/0343656 A1 * 12/2015 Repac ..... E05D 7/1072 83/167
2016/0229075 A1 * 8/2016 Fastabend ..... B26D 3/185
2018/0154536 A1 * 6/2018 Repac ..... B26D 3/185
2020/0047368 A1 * 2/2020 Jin ..... B26D 5/10
2020/0078971 A1 * 3/2020 Sweeney ..... B26D 1/03
2020/0338777 A1 * 10/2020 Beliveau ..... B26D 7/0608
2021/0237302 A1 * 8/2021 Rhodes ..... B26D 7/2614

* cited by examiner

MANUAL PRODUCE SLICER

CROSS-REFERENCE TO RELATED APPLICATIONS

The present application claims the benefit of and priority to U.S. Provisional Patent Application No. 62/869,336, filed Jul. 1, 2019, the entire disclosure of which is hereby incorporated by reference herein.

BACKGROUND

The present disclosure relates generally to the field of food processing devices such as manual food slicers, for example for use with produce items (e.g., fruits, vegetables, tomatoes, onions, apples, peppers, etc.) or other food items (e.g., bread, cheese, etc.). Manual food slicers (e.g., manual food slicers) are mechanical assemblies used to slice food items (i.e., to divide food items into multiple pieces, slices, chunks, etc.).

One goal of a manual food slicer is to consistently achieve clean cuts through the food item without deforming, squishing, smashing, bruising, or otherwise mangling the produce item. Another goal of a manual food slicer is increased usability and efficiency, which may be achieved by reducing the time required to slice multiple food items, reducing the amount of force exerted by a user to slice the food item, and reducing the skill required to operate the manual food slicer.

Existing manual food slicers may not satisfactorily achieve these or other goals. Accordingly, improved manual food slicers may be advantageous.

SUMMARY

One implementation of the present disclosure is a manual food processor. The manual food processor includes a base, a plurality of blades coupled to the base and extending from the base in a vertical direction, a rod coupled to the base and oriented at an acute angle relative to the vertical direction of the blade, and a carriage slidable along the rod from a top end of the rod to a bottom end of the rod. The carriage is configured to support a food item from below the food item and to push the food item from above the food item. The carriage is positioned entirely on a first side of the plurality of blades when at the top end of the rod and is intersected by the plurality of blades at the bottom end of the rod.

Another implementation of the present disclosure is a method of slicing a food item. The method includes placing the food item in a carriage of a manual food processor. The method also includes drawing the food item along and across a plurality of blades to slice the food item by moving the carriage from a first position to a second position along a rod positioned at an acute angle relative to the plurality of blades, wherein the carriage is located entirely on a first side of the plurality of blades when in the first position and is intersected by the plurality of blades at the second position.

Another implementation of the present disclosure is manual food processor to slice a food item. The manual food processor includes a base including a foundation and a platform spaced apart from the foundation such that base is configured to allow a container to be positioned between the platform and the foundation, a plurality of blades extending from the platform, a plurality of rods extending from the platform at an acute angle relative to the blades, and a carriage. The carriage is slidable along the plurality of rods from a first position to a second portion and configured to retain the food item such that the food item moves in accordance with movement of the carriage. The carriage is located entirely on a first side of the plurality of blades when in the first position and is intersected by the plurality of blades when in the second position.

DETAILED DESCRIPTION

Figure 1:
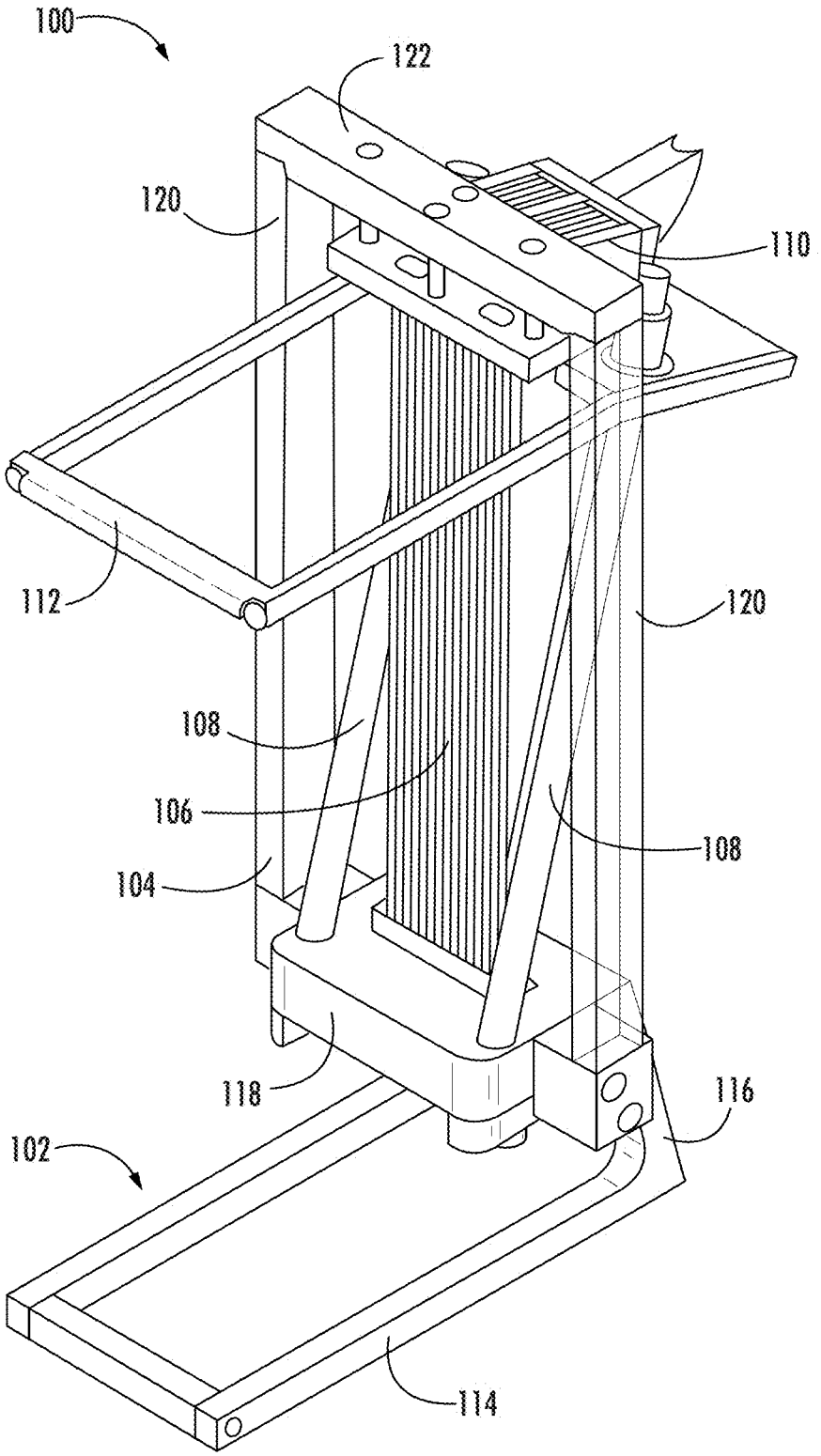
FIG. 1 is a perspective view of a manual food slicer, according to some embodiments.
Figure 2:
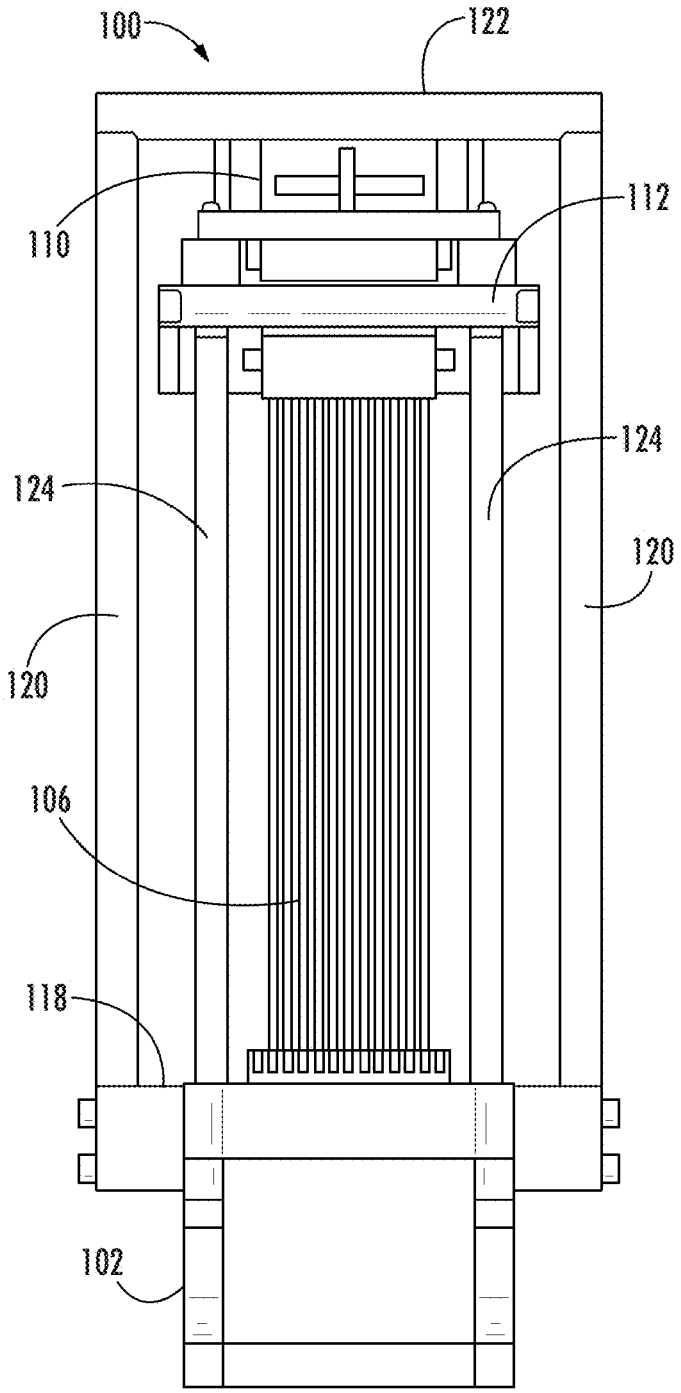
FIG. 2 is a front view of the manual food slicer of FIG. 1, according to some embodiments.
Figure 3:
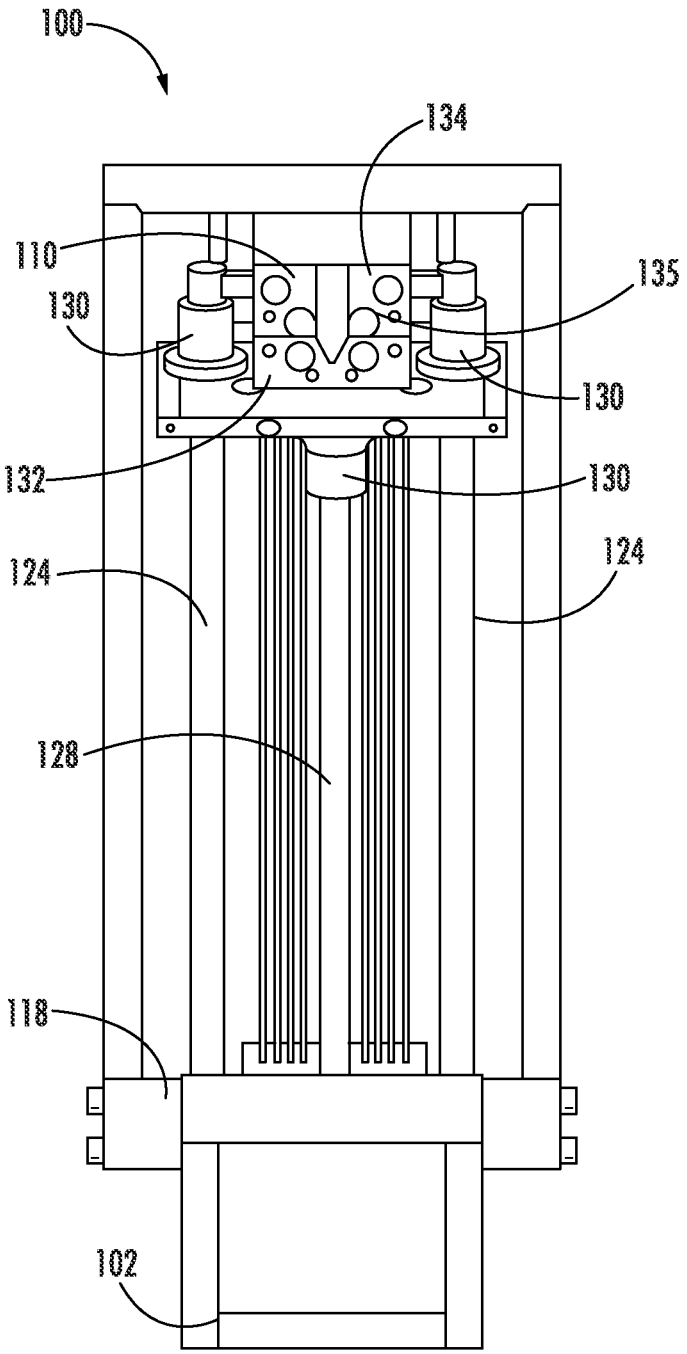
FIG. 3 is a rear view of the manual food slicer of FIG. 1, according to some embodiments.
Figure 4:
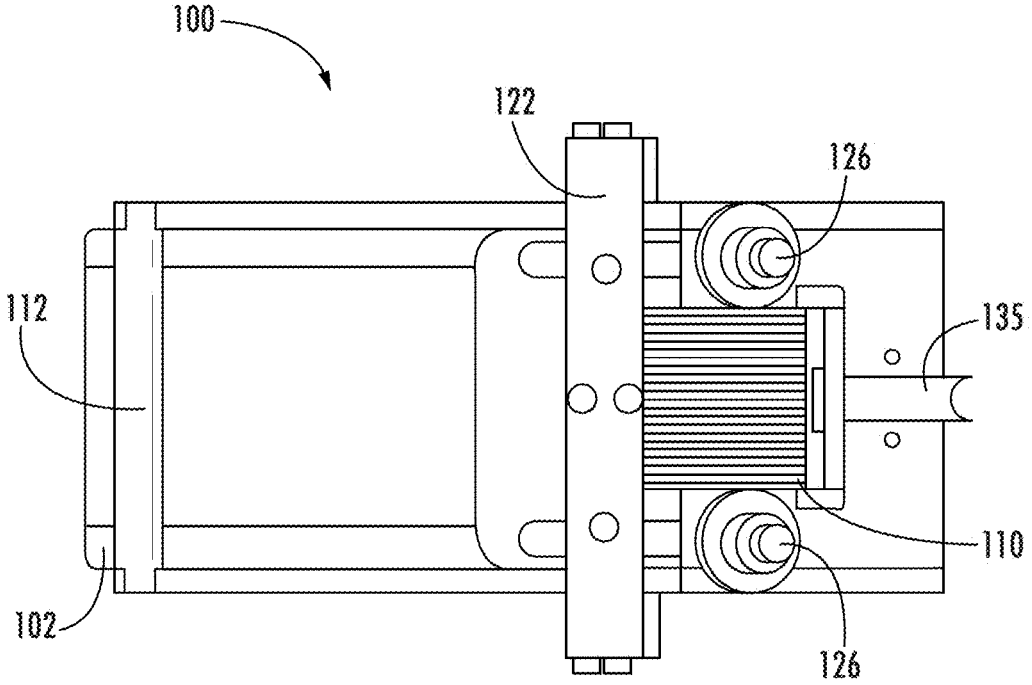
FIG. 4 is a top view of the manual food slicer of FIG. 1, according to some embodiments.
Figure 7:
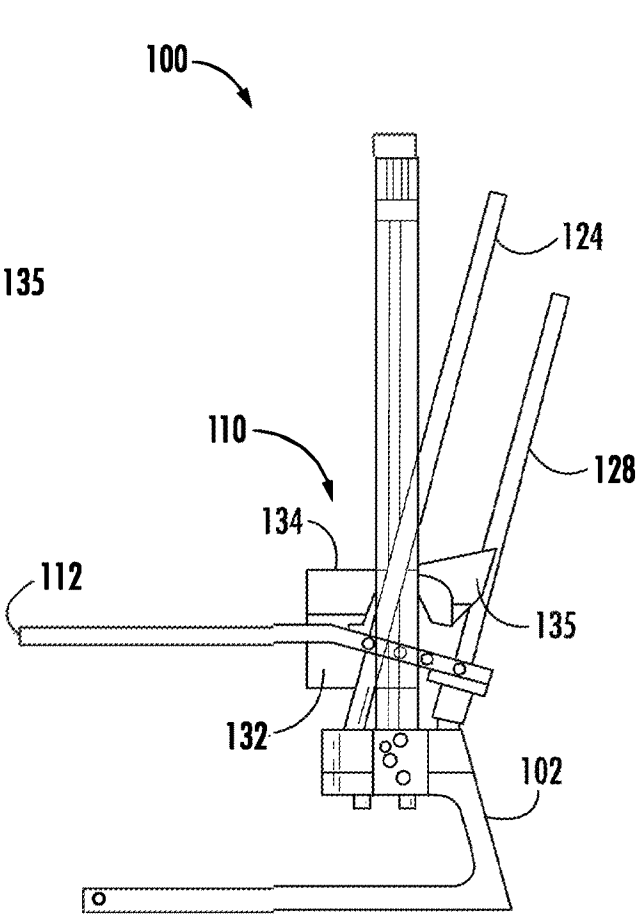
FIG. 7 is a third side view of the manual food slicer of FIG. 1, according to some embodiments.
Figure 6:
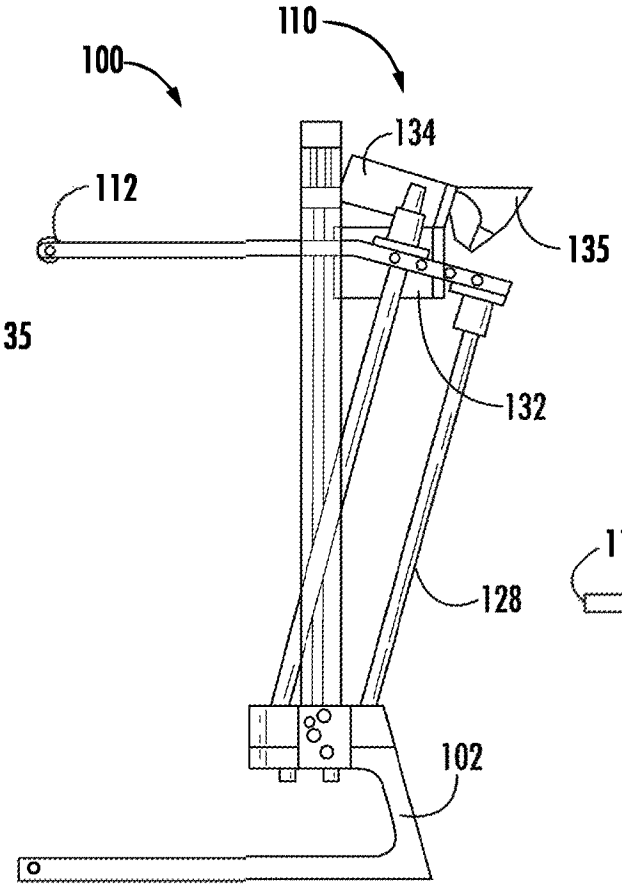
FIG. 6 is a second side view of the manual food slicer of FIG. 1, according to some embodiments.
Figure 5:
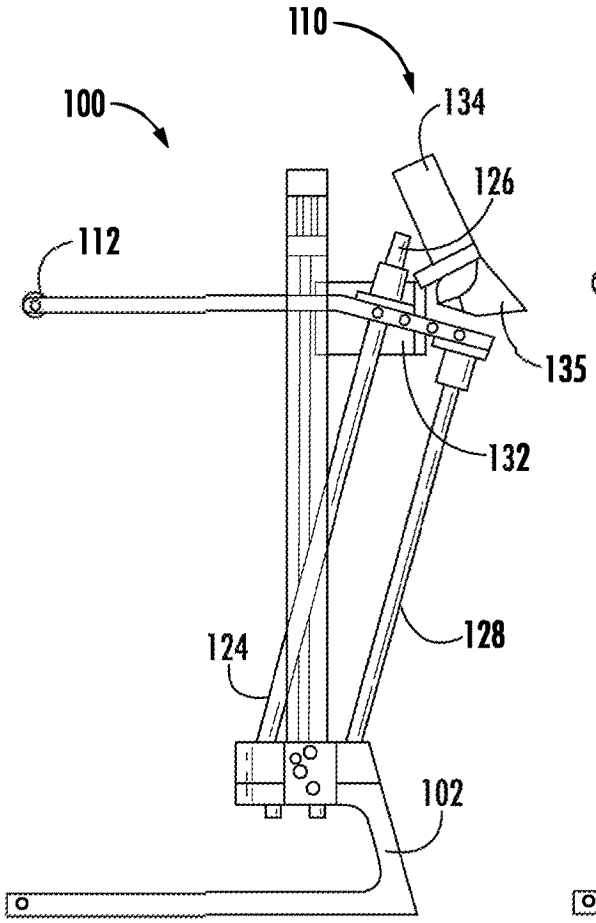
FIG. 5 is a first side view of the manual food slicer of FIG. 1, according to some embodiments.
Figure 8:
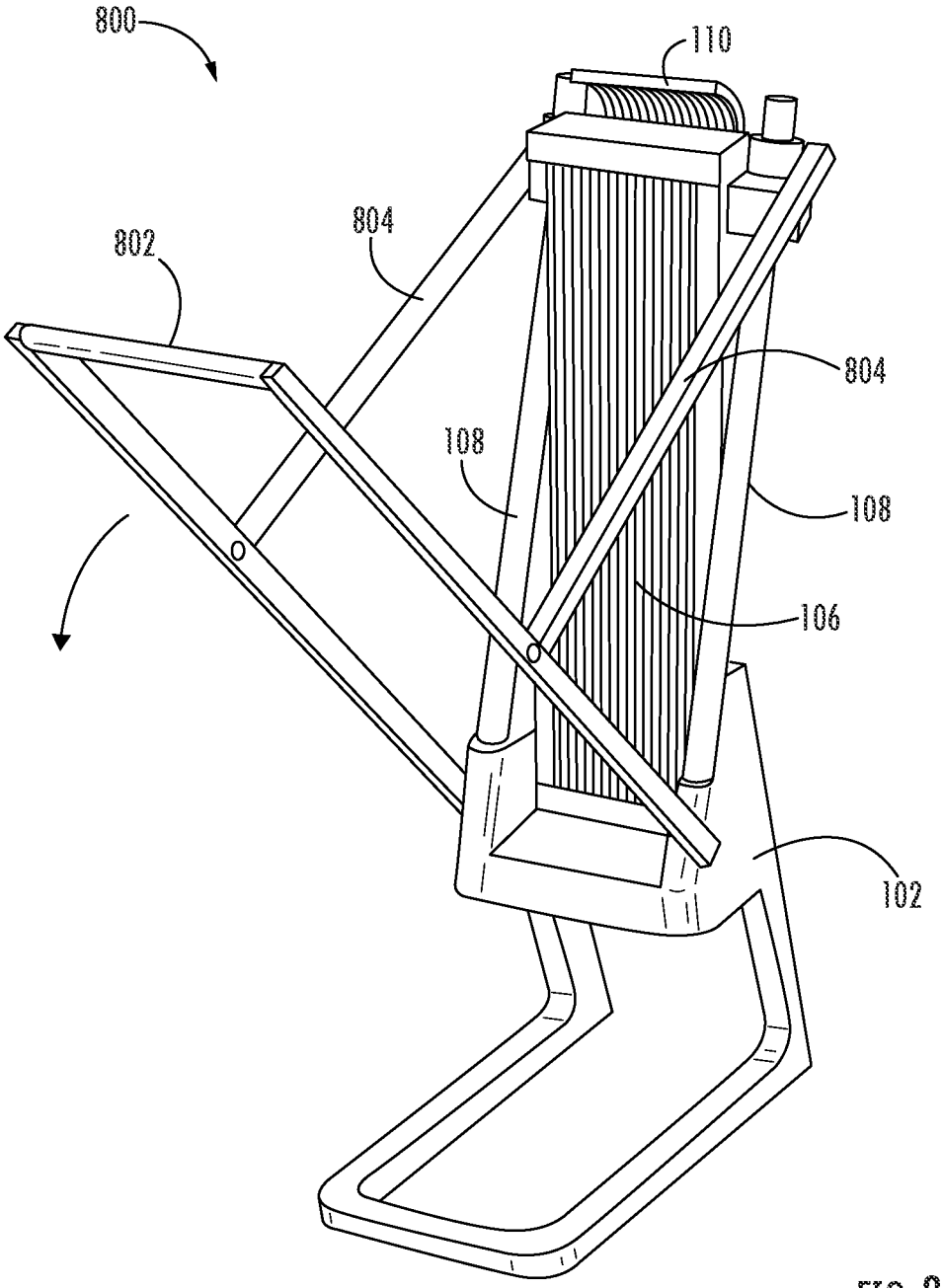
FIG. 8 is a first perspective view of a manual food slicer, according to some embodiments.

Referring to FIGS. 1-7, a manual food slicer (manual food processor) 100 is shown, according to some embodiments. FIG. 1 shows a perspective view of the manual food slicer 100. FIG. 2 shows a front view of the manual food slicer 100. FIG. 3 shows a rear view of the manual food slicer 100. FIG. 4 shows a top view of the manual food slicer 100. FIGS. 5-7 show side views of the manual food slicer 100. The manual food slicer 100 is configured to receive a food item, draw the food item along and across a set of blades to slice the food item, and release the sliced food item into a container.

As shown in FIGS. 1-7, the manual food slicer 100 includes a base 102, a frame 104 coupled to the base 102 and extending vertically from the base 102 (i.e., in a substantially vertical direction), a blade set 106 coupled to the frame 104 and extending vertically from the base 102, multiple rods 108 coupled to the base 102 and oriented at an acute angle relative to the vertical direction of the blades, a carriage 110 slideably coupled to the rods 108, and a handle 112 fixedly coupled to the carriage 110.

The base 102 includes a rectangular portion 114 configured to sit on a table, countertop, or other flat surface and provide a stable foundation for the manual food slicer 100. The base 102 also includes a stand 116 that extends from an end of the rectangular portion 114. The stand 116 protrudes above the rectangular portion 114 and includes a platform 118 which is positioned above the rectangular portion 114. The platform 118 is spaced apart from the rectangular portion 114 such that a container (bowl, bucket, box, tray, plate, etc.) can be positioned between the platform 118 and the rectangular portion 114.

The frame 104 is coupled to the stand 116 and extends vertically from the platform 118. As shown in FIGS. 1-7, the frame 104 is a rectangular shape that includes a pair of side bars 120 and a top bar 122. The side bars 120 are oriented in an approximately vertical direction, i.e., approximately perpendicular to the rectangular portion 114 and to a surface (table, countertop, etc.) on which the manual food slicer 100 is positioned.

The blade set 106 extends from the platform 118 to the top bar 122 of the frame 104. The blade set 106 is coupled to the platform 118 and the top bar 122 of the frame 104. The blade set 106 includes multiple blades, for example in a range between five and fifteen blades. The blades may have a length of approximately sixteen inches. In other embodiments, the blades have a length in a range between approximately ten inches and approximately twelve inches. In the embodiments shown in FIGS. 1-7, eleven blades are includes. The blades may be serrated, straight (i.e., non-serrated), or some combination thereof in various embodiments.

Each blade in the blade set 106 is oriented in an approximately vertical direction. The blades of the blade set 106 are oriented such that a sharp edge of each blade faces towards a first side of the blade set 106 and the frame 104 (to the right from the perspective of FIGS. 5-7), and such that the blades are aligned in a plane defined by the frame 104. As can be seen from the perspectives of FIGS. 2-3, the blades of the blade set 106 are spaced apart from one another, for example equidistantly spaced. The spacing between the blades corresponds to a resulting thickness of slices of a food item following processing by the manual food processor 100. Accordingly, the blades of the blade set 106 may be spaced in accordance with user requirements and/or industry standards for slice thickness of the food item. In the embodiments shown, the blades are stationary during use of the manual food processor.

The rods (rails) 108 extend upwards from the platform 118 of the base 102 at an acute angle relative to the approximately vertical direction of the blade set 106. In the embodiments shown, the angle between a vertical reference axis and the rods 108 is approximately fifteen degrees. In other embodiments, the angle may be in a range between approximately five degrees and approximately twenty five degrees. In the example shown, the rods 108 are substantially cylindrical. Other shapes are possible in other embodiments.

The manual food processor 100 is shown to include three rods 108 arranged in a triangular formation. As shown, a front pair of rods 108 (denoted as front rods 124) are positioned on either side of the blade set 106. The front rods 124 are coupled to the platform 118 at a second side of the blade set 106 (a non-sharp side, to the left of the blade set 106 as shown from the perspective of FIGS. 5-7). The angular orientation of the front rods 124 is such that the front rods 124 extend along and across the blade set 106 to a top end 126 of the front rods 124 positioned on the first side of the blade set 106 (a sharp side, to the right of the blade set 106 as shown from the perspective of FIGS. 5-7). The rods 108 also include a third rod (denoted as back rod 128). The back rod 128 is parallel to the front rods 124 and is coupled to the platform 118 on the first side of the blade set 106. The back rod 128 is shown as equidistantly spaced from the two front rods 124. Although three rods 108 are shown in the embodiments herein, it should be understood that a different number of rods 108 may be used in other embodiments (e.g., one, two, four, five, etc.).

The carriage 110 (e.g., receptacle, holder, etc.) is slideably coupled to the rods 108 between a first (initial, loading, etc.) position and a second (final, processed, sliced, etc.) position. In other words, the carriage 110 is positioned on the rods 108 and configured to slide along the rods 108. The rods 108 guide the carriage 110 between the first position and second position. As shown, the carriage 110 is coupled to the rods 108 by a linkage formed by collars (sleeves, etc.) 130 mounted on the rods 108 and coupled to the carriage 110. Each collar 130 is fixedly coupled to the carriage 110 and positioned on a rod 108 such that the rod 108 extends through the collar 130. Three collars 130 are shown, each receiving one of the three rods 108. The collars 130 may include various bearings, lubricated materials, frictional materials, etc. to provide a desired degree of ease of movement along the rods 108. A handle 112 is fixedly coupled to the carriage 110 and is configured to be manipulated (actuated, operated, pivoted, etc.) by a user to move the carriage 110 along the rods 108. In the embodiment shown, the handle 112 extends around the blade set 106 to allow a user to manipulate the handle 112 from a non-sharpened side of the blade set 106.

The carriage 110 includes a bottom portion 132 and a top portion 134 rotatably coupled to the bottom portion 132. The bottom portion 132 is configured to support a food item from below, and the top portion 134 is configured to retain the food item within the carriage 110 from above (e.g., to prevent the food item from moving more than a threshold distance above the bottom portion 132).

The bottom portion 132 and the top portion 134 are slotted and/or formed of a plurality of parallel projections such that gaps (slots, spaces, channels, etc.) are left in the carriage 110 which align with the blades of the blade set 106. That is, each blade is aligned with a corresponding gap in the carriage 110 (i.e., in the bottom portion 132 and the top portion 134). The carriage 110 is thereby enabled to pass at least partially through (across) the blade set 106 (in a horizontal direction) and to slide along the blade set 106 (in a vertical direction).

FIGS. 5-7 illustrate operation of the manual food slicer 100. As shown in FIG. 5, the carriage 110 is located in the first position, at a top of the rods 108 and to the right (i.e., on a sharpened side) of the blade set 106. The top portion 134 of the carriage 110 is rotated to an open position such that a food item (e.g., produce item, fruit, vegetable, tomato, onion) can be inserted into the carriage 110. The top portion 134 is fixedly coupled to a projection 135. The projection 135 provides a counterweight to the top portion 134 which causes the top portion 134 to rotate to the open position when the carriage 110 is at the top of the rails.

As shown in FIG. 6, the top portion 134 of the carriage 110 is rotated towards a closed position. In the closed position, the food item is confined between the bottom portion 132, the top portion 134, and the blade set 106. In some embodiments, the top portion 134 is rotated closed by a user manipulating the top portion 134. In the embodiment shown, the top portion 134 is configured to automatically rotate to the closed position when the carriage 110 begins to move in a downward direction along the rods 108. In the embodiment shown, the projection 135 is configured to contact the back rod 128 and to slide along the back rod 128. When the projection 135 contacts the back rod 128 (as shown in FIG. 7) the interaction between the projection 135 and the back rod 128 causes the top portion 134 to be rotated into the closed position (i.e., to close the carriage 110). When the projection 135 is not in contact with the back rod 128 (as shown in FIG. 5), the weighted projection 135 causes the top portion 134 to rotate to the open position (due to the force of gravity on the projection 135). The length of the back rod 128 is selected such that the projection 135 is out of contact with the back rod 128 when the carriage 110 is at the top of the front rods 124 and the projection 135 comes into contact and stays in contact with the back rod 128 as the carriage 110 is moved along and across the blade set 106. Repeated loading of a food item into the carriage 110 is thereby facilitated, without requiring direct manipulation of the top portion 134 by a user.

As shown in FIG. 7, the carriage 110 is in the second position, at a bottom end of the rods 108 and the blade set 106 proximate the platform 118. The carriage 110 extends across the blade set 106 such that the food item carried by the blade set 106 has passed across the blade set 106, and, as a result, is now divided in to multiple slices. That is, to transition from the state shown in FIG. 6 to the state shown in FIG. 7, the carriage 110 is drawn in a diagonal direction relative to the blades (i.e., parallel to the rods 108).

The food item carried by the carriage 110 is drawn both along the blade set 106 (in the vertical direction) and through the blade set 106 (in the horizontal direction). The top portion 134 of the carriage 110 prevents the blade set 106 from forcing the food item upwards and more than a threshold distance away from the bottom portion 132 of the carriage 110. The food item thereby experiences a smooth, consistent "slicing" movement along the blades. This slicing movement of the food item relative to the blades is consistent with proper knife technique for slicing food items using a single knife. The slicing movement provides clean cuts through the carriage 110 by moving the food item along the blade set 106 at a small angle (e.g., 15 degrees) rather than pushing the food item into fixed blades at a substantially orthogonal angle (which may result in squishing and bruising). Furthermore, this slicing movement reduces the amount of force necessary to execute a slicing process compared to other food slicers, both due to the diagonal movement and the assistance of gravity in pulling the producing item along and across the blade set 106.

As shown in FIG. 7, the carriage 110 is configured to release the food item when the carriage 110 is at the bottom of the rods 108. For example, the carriage 110 may include an opening on a front (i.e., to the left in FIG. 7) of the carriage 110. When the carriage 110 is positioned as shown in FIGS. 5 and 6, the blade set 106 may prevent the food item from escaping the carriage 110 via such an opening. After the carriage 110 is translated across the blade set 106 and the food item has been sliced, the opening may then be positioned on the second side of the blades (i.e., to the left in FIG. 7), such that the food item can then be removed and/or automatically fall from the carriage 110. The bottom portion 132 of the carriage 110 may be tilted such that the food item slides out of the carriage 110 via the opening after passing through the blade set 106. A container can be placed below the carriage 110 such that the sliced food item is released into the container.

The carriage 110 can then be lifted back into the position shown in FIG. 5. In some embodiments, the top portion 134 of the carriage 110 is configured to automatically rotate to the open position of FIG. 5 when the carriage 110 is lifted upwards to the top of the rods 108. The carriage 110 is thereby returned to a position to receive another (additional) food item for slicing (i.e., via positioning of the additional food item in the carriage 110 by a user). It should be understood that the manual food slicer 100 can be used repeatedly to slice many food items (e.g., many tomatoes) by repeatedly transitioning the carriage 110 through the states shown in FIGS. 5-7.

Referring now to FIGS. 8-11, a manual food slicer 800 is shown, according to some embodiments. The manual food slicer 800 includes many of the same features as the manual food slicer 100 of FIGS. 1-7, with differentiating features of the manual food slicer 800 described below.

Figure 9:
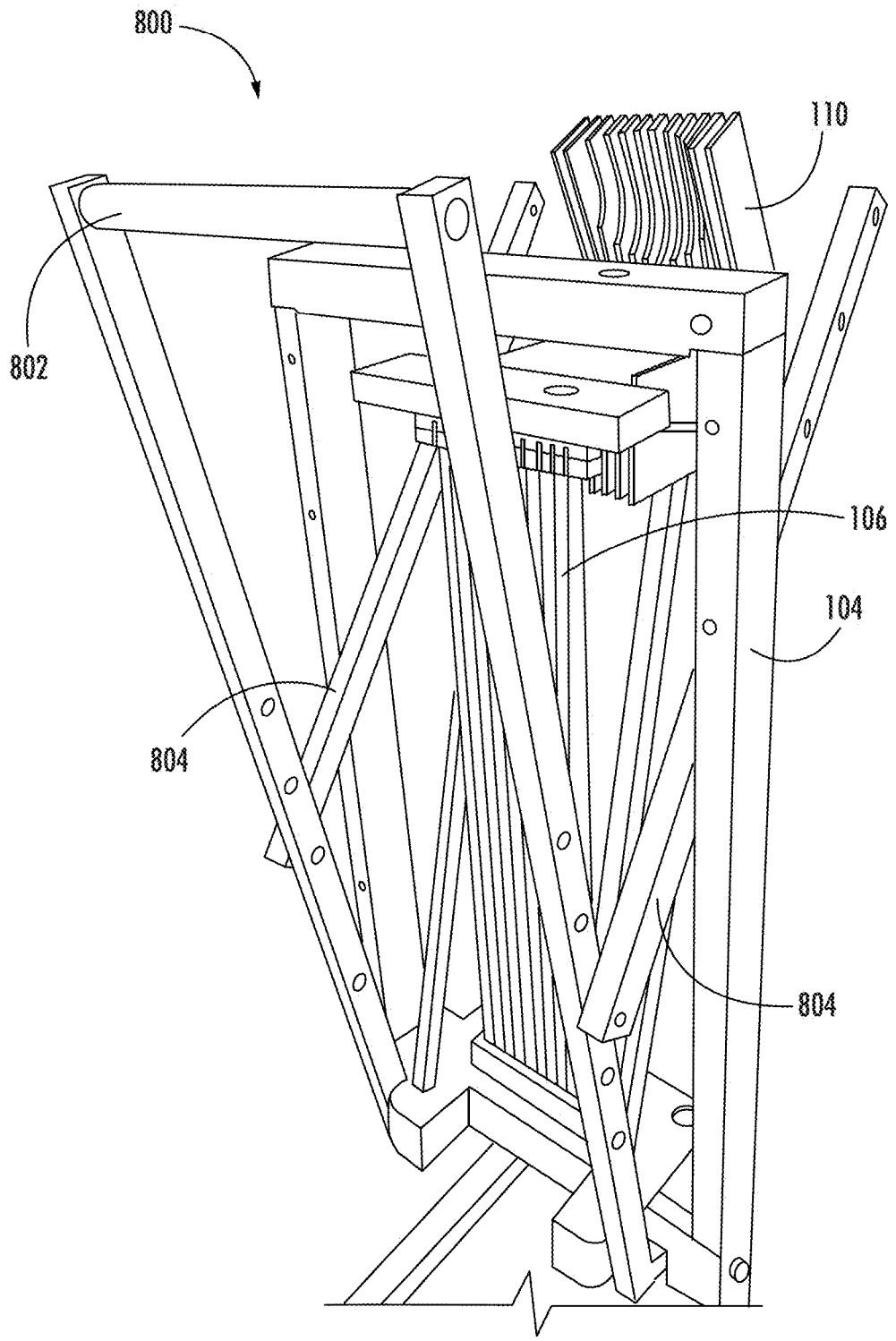
FIG. 9 is a second perspective view of the manual food slicer of FIG. 8, according to some embodiments.
Figure 10:
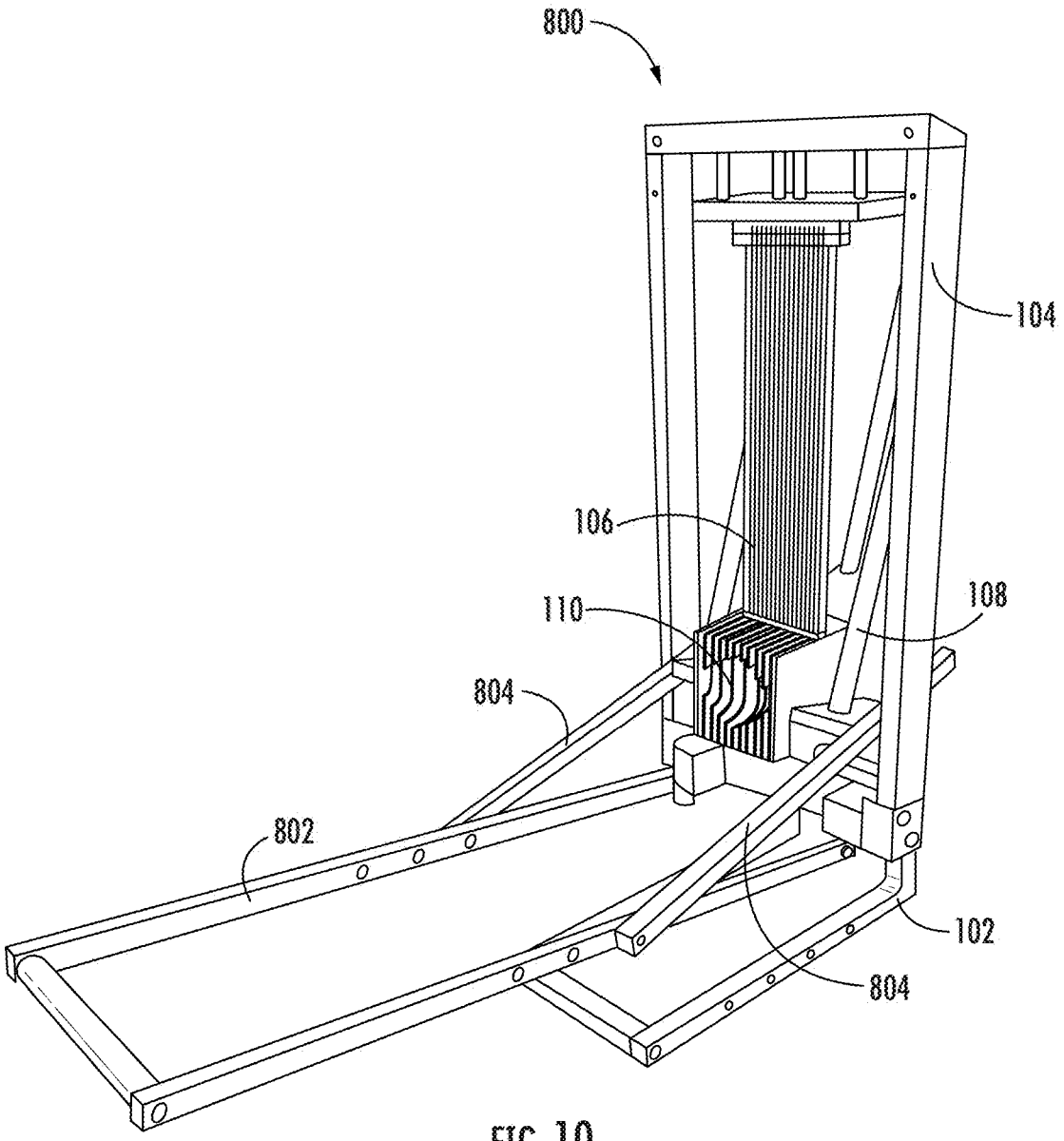
FIG. 10 is third perspective view of the manual food slicer of FIG. 8, according to some embodiments.
Figure 11:
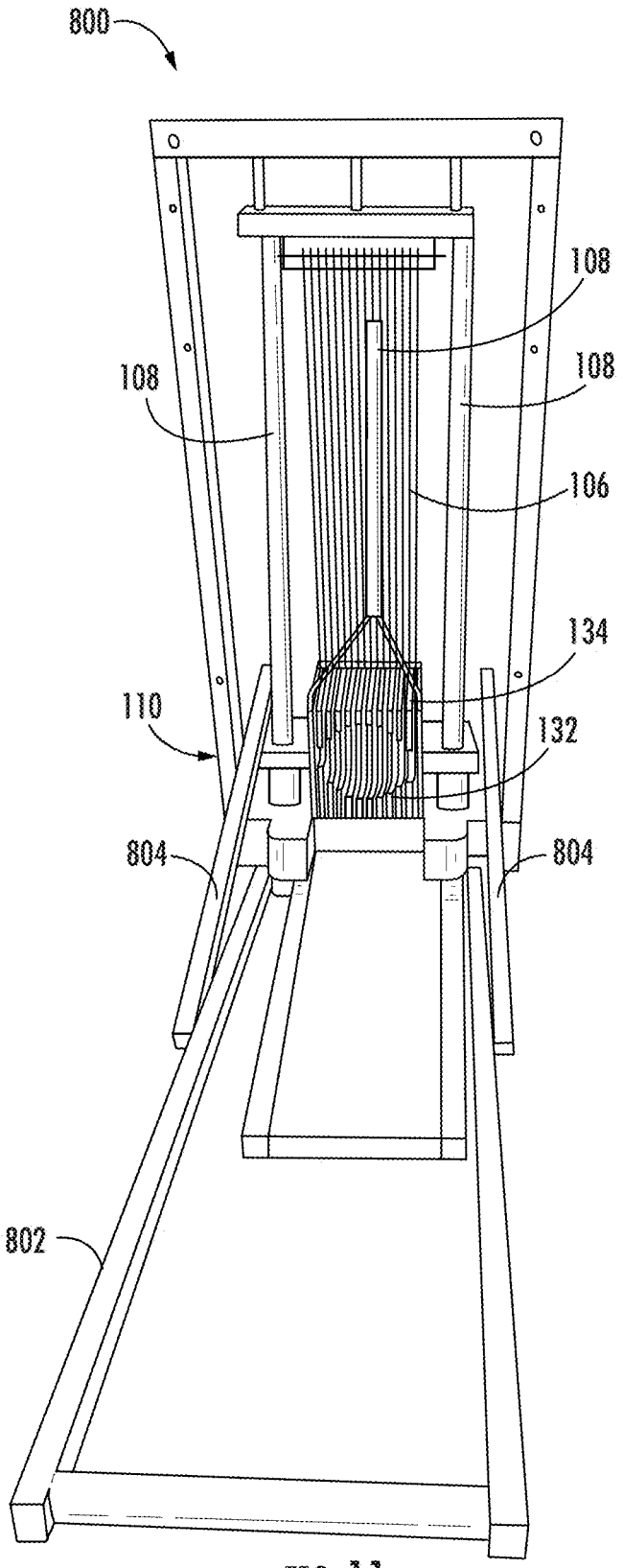
FIG. 11 is a front perspective view of the manual food slicer of FIG. 11, according to some embodiments.

As shown in FIGS. 8-11, a handle 802 is rotatably coupled to the base 102. The handle 802 is rotatable between a substantially vertical orientation (e.g., approximately parallel with the frame 104) and a substantially horizontal orientation (e.g., approximately parallel with the rectangular portion 114). Connecting rods 804 are rotatably coupled to both the handle 802 and the carriage 110, and are configured to cause translation of the carriage 110 along the rods 108 when the handle 802 is rotated relative to the base 102. When the handle 802 is in the substantially vertical orientation, the carriage 110 is forced to a top of the rods 108 (e.g., as shown in FIG. 9). Advantageously, the arrangement of the handle 802 and the connecting rods 804 when the carriage 110 is at a top of the rods 108 may resist a gravitational force on the carriage 110, i.e., such that the carriage 110 remains at the top of the rods 108 without an external (e.g., human) force on the handle 802 or the carriage 110). When the handle 802 is rotated to the substantially horizontal orientation, the carriage 110 is moved along and across the blade set 106 to a bottom of the rods 108 (e.g., as shown in FIGS. 10 and 11).

The manual food slicer 800 can therefore be operated by rotating the handle 802 to the substantially vertical orientation, placing a food item in the carriage 110, rotating the handle 802 to the substantially horizontal orientation, and discharging the food item from the carriage 110. Those steps can be repeated any number of times to slice any number of food items.

Figure 12:
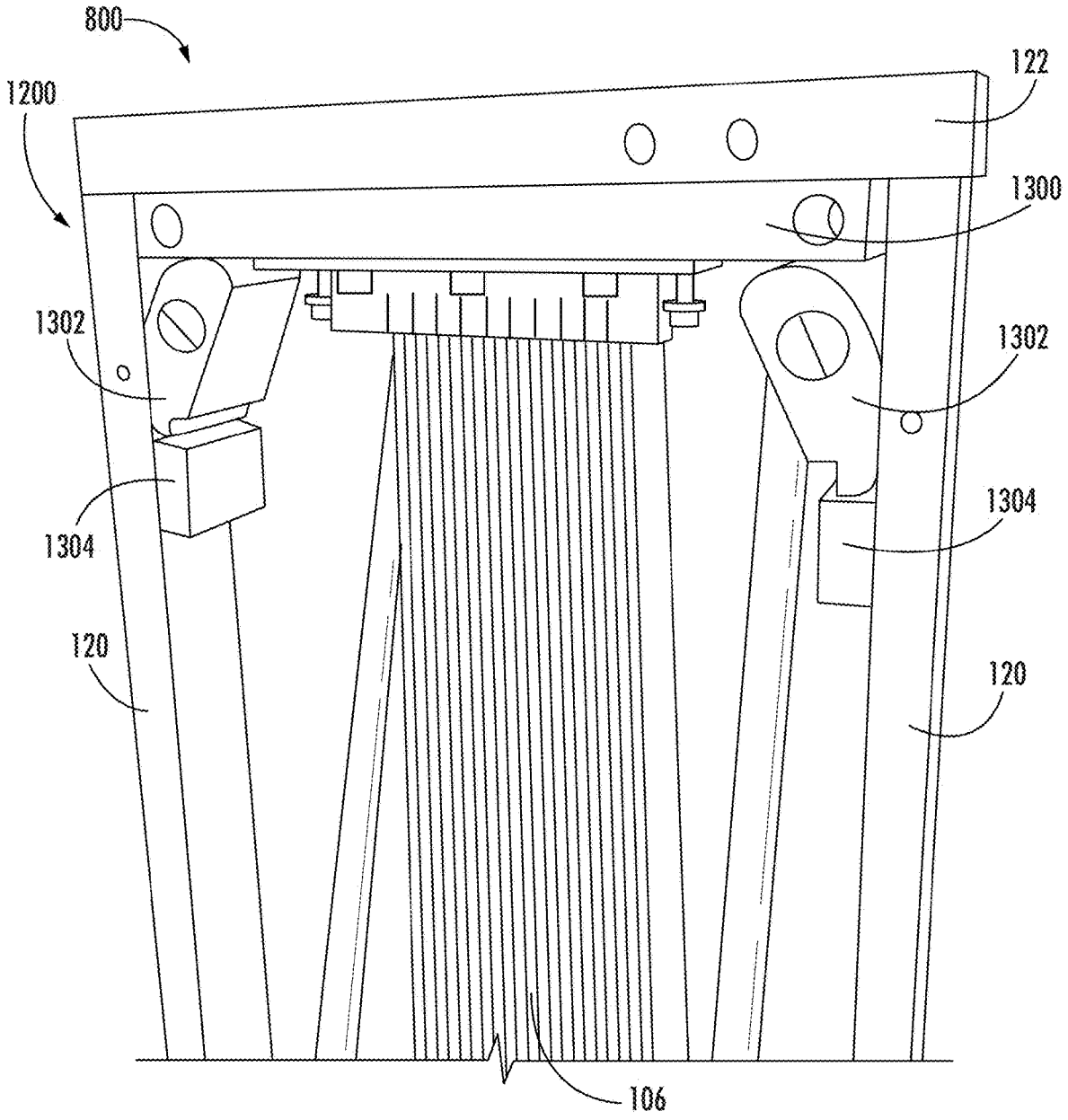
FIG. 12 is a perspective view of another embodiment of the manual food slicer of FIG. 8, according to an exemplary embodiment.

Referring now to FIG. 12, another embodiment of the manual food slicer 800 is shown, according to an exemplary embodiment. As shown in FIG. 12, the manual food slicer 800 includes a tension adjustment system 1200 that facilitates installation, removal, and tensioning of the blade set 106. In the embodiment of FIG. 12, the blade set 106 is coupled to a support bar 1300 at a upper end of the blade set 106. In some embodiments, the support bar 1300 is slideably coupled to the top bar 122 of the frame 104 such that a distance between the support bar 1300 and the top bar 122 can be adjusted. Decreasing the distance between the support bar 1300 and the top bar 122 (i.e., increasing a distance between the support bar 1300 and the base 102) increases the tension in the blade set 106.

FIG. 12 also shows a pair of cams 1302 rotatably coupled to the side bars 120 of the frame 104. The cams 1302 are configured to rotate about an axis oriented approximately normal to a plane defined by the blade set 106. The cams 1302 engage (push against) the support bar 1300 and at least partially support the support bar 1300 from beneath the support bar 1300. Due to a shape of the cams 1302, the cams alter a height of the support bar 1300 relative to the base 102 as the cams 1302 are rotated, thereby adjusting the tension in the blade set 106. For example, as shown in FIG. 12, the cams have a semi-elliptical shape, such that the support bar 1300 is forced further from an axis of rotation of the cams 1302 when curved portions of the cams 1302 abut the support bar 1300, thereby increasing tension in the blade set 106. The tension in the blade set 106 can be released by rotating the cams 1302 such that a flat/planar portions of the cams 1302 face the support bar 1300.

In the example of FIG. 12, each cam 1302 also engages a step 1304 extending from a side bar 120. The engagement between the steps 1304 and the cams 1302 may resist rotation of the cams 1302 out of the orientation shown in FIG. 12, which corresponds to a high-tension state of the blade set 106. The steps 1304 and the cams 1302 are configured such that a user can force rotation of the cams 1302 away from the steps 1304 to release the tension in the blade set 106, for example to facilitate cleaning and/or replacement of the blade set 106. The manual food slicer 800 is thereby configured to facilitate installation, removal, cleaning, tension adjustment, etc. of the blade set 106.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and are considered to be within the scope of the disclosure.

Other arrangements and combinations of the elements described herein and shown in the Figures are also contemplated by the present disclosure. The construction and arrangement of the systems and apparatuses as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. Other substitutions, modifications, changes, and omissions can be made in the design, operating conditions and arrangement of the exemplary embodiments without departing from the scope of the present disclosure.

What is claimed is:

1. A manual food processor to slice a food item, the manual food processor comprising:

a base;

a plurality of blades coupled to the base and extending from the base in a substantially vertical direction;

a rod coupled to the base and oriented at an acute angle relative to the blades, a first end of the rod proximate the base and a second end of the rod spaced apart from the base in the substantially vertical direction;

a carriage slidable along the rod from a first position disposed toward the first end of the rod to a second position disposed toward the second end of the rod, the carriage configured to support the food item from below the food item and to push the food item from at least above the food item; and a projection coupled to the carriage and configured to cause articulation of a first portion of the carriage relative to a second portion of the carriage such that:

the carriage opens up to receive the food item when the carriage is positioned at the first end of the rod; and the carriage closes to retain the food item when the carriage is translated along the rod;

wherein the carriage is located entirely on a first side of the plurality of blades when in the first position and is intersected by the plurality of blades at the second position.

2. The manual food processor of claim 1, wherein the projection is configured to engage the rod to cause the articulation of the portion of the carriage.

3. The manual food processor of claim 1, wherein the carriage comprises a plurality of gaps, each gap configured to receive one of the plurality of blades.

4. The manual food processor of claim 1, wherein the acute angle is approximately fifteen degrees.

5. The manual food processor of claim 1, comprising a handle fixedly coupled to the carriage.

6. The manual food processor of claim 1, comprising:

a handle rotatably coupled to the base; and a connecting rod extending from the handle to the carriage, the connecting rod rotatably coupled to the handle and the carriage.

7. The manual food processor of claim 6, wherein the carriage moves along the rod when the handle is rotated relative to the base.

8. The manual food processor of claim 1, comprising:

a support bar coupled to an upper end of the blades;

a side bar coupled to the base and extending parallel to the blades;

a cam rotatably coupled to the side bar and configured to engage the support bar, wherein rotation of the cam alters a distance between the support bar and the base thereby adjusting a tension in the blades.

9. A manual food processor to slice a food item, the manual food processor comprising:

a base comprising a foundation and a platform spaced apart from the foundation such that base is configured to allow a container to be positioned between the platform and the foundation;

a plurality of blades extending from the platform, wherein the blades are stationary relative to the base;

a plurality of rods extending from the platform at an acute angle relative to the blades, wherein the rods are stationary relative to the base;

a carriage slidable along the plurality of rods from a first position to a second position, the carriage configured to retain the food item such that the food item moves in accordance with movement of the carriage; and a projection coupled to the carriage and configured to cause articulation of a first portion of the carriage relative to a second portion of the carriage such that:

the carriage opens up to receive the food item when the carriage is positioned at the first position; and the carriage closes to retain the food item when the carriage is translated away from the first position toward the second position.

wherein the carriage is located entirely on a first side of the plurality of blades when in the first position and is intersected by the plurality of blades when in the second position.

10. The manual food processor of claim 9, wherein the projection is configured to engage one of the plurality of rods to cause the articulation.

* * * * *